US009533786B1

(12) United States Patent
Feinstein

(10) Patent No.: US 9,533,786 B1
(45) Date of Patent: Jan. 3, 2017

(54) SELF-FITTING, SELF-ADJUSTING, AUTOMATICALLY ADJUSTING AND/OR AUTOMATICALLY FITTING FASTENER OR CLOSING DEVICE FOR PACKAGING

(71) Applicant: Peter A. Feinstein, Shavertown, PA (US)

(72) Inventor: Peter A. Feinstein, Shavertown, PA (US)

(73) Assignee: Feinstein Patents, LLC, Wilkes-Barre, PA (US)

( * ) Notice: Subject to any disclaimer, the term of this patent is extended or adjusted under 35 U.S.C. 154(b) by 0 days.

(21) Appl. No.: 15/211,139

(22) Filed: Jul. 15, 2016

(51) Int. Cl.

| | |
|---|---|
| ***G06F 7/00*** | (2006.01) |
| ***B65B 51/04*** | (2006.01) |
| ***B65B 11/00*** | (2006.01) |
| ***B65D 65/02*** | (2006.01) |

(52) U.S. Cl.
CPC ..... *B65B 51/04* (2013.01); *B65B 11/004* (2013.01); *B65D 65/02* (2013.01)

(58) Field of Classification Search
None
See application file for complete search history.

(56) References Cited

U.S. PATENT DOCUMENTS

| | | | |
|---|---|---|---|
| 5,607,756 | A | 3/1997 | Yamauchi et al. |
| 5,752,926 | A | 5/1998 | Larson et al. |
| 6,387,066 | B1 | 5/2002 | Whiteside |
| 7,172,565 | B2 | 2/2007 | Termanini |
| 7,868,221 | B2 | 1/2011 | Munch-Fals et al. |
| 8,069,858 | B2 | 12/2011 | Gall |
| 8,100,843 | B2 | 1/2012 | Rousseau et al. |
| 8,918,978 | B2 * | 12/2014 | Kirkwood ..... F16B 1/0014 29/447 |

(Continued)

FOREIGN PATENT DOCUMENTS

| | | |
|---|---|---|
| CN | 1502313 A | 6/2004 |
| EP | 0761188 A2 | 3/1997 |

(Continued)

OTHER PUBLICATIONS

Yao-Jen Lai, et al., "An experimental investigation on shape memory alloy dynamic splint for a finger joint application", Sensors and Actuators A 173 (2012) 210-218.

*Primary Examiner* — Yolanda Cumbess
(74) *Attorney, Agent, or Firm* — St. Onge Steward Johnston & Reens, LLC

(57) ABSTRACT

Provided is a self-closing and automatically fitting device for packaging (e.g. shrink wrapping, fasteners, enclosures of objects). The device includes a wrapping material and/or closure bands/straps which are made of a shape memory material and a non-shape memory material. The device also includes at least one pair of clasp members attached to the wrapping material and/or closure bands/straps. Upon stimulation by a trigger source, the shape memory material deforms and brings the wrapping material to self-assemble about an object to be packed. The self-assembly of the wrapping material and/or closure bands/straps further brings the two clasp members close to each other and facilitate the clasp thereof to form a self-assembled and closed package. The device may also include a motor, a control unit, and sensors which enable a motor actuated fine tensioning of the self-assembled and closed package.

20 Claims, 8 Drawing Sheets

(56) References Cited

U.S. PATENT DOCUMENTS

| | | | | |
|---|---|---|---|---|
| 8,926,534 | B2 | 1/2015 | McBean et al. | |
| 2004/0031238 | A1* | 2/2004 | Cox | B65B 11/045 53/399 |
| 2013/0303957 | A1 | 11/2013 | Bauerfeind | |
| 2014/0142485 | A1 | 5/2014 | Berry et al. | |
| 2014/0257156 | A1 | 9/2014 | Capra et al. | |
| 2015/0173993 | A1 | 6/2015 | Walsh et al. | |
| 2015/0290015 | A1 | 10/2015 | Elahinia et al. | |
| 2016/0221308 | A1* | 8/2016 | Feinstein | F03G 7/00 |

FOREIGN PATENT DOCUMENTS

| | | | |
|---|---|---|---|
| ES | 2544890 | A1 | 9/2015 |
| GB | 2482298 | A | 1/2012 |
| JP | 2003144473 | A | 5/2003 |
| WO | 2011082176 | A1 | 7/2011 |

* cited by examiner

SELF-FITTING, SELF-ADJUSTING, AUTOMATICALLY ADJUSTING AND/OR AUTOMATICALLY FITTING FASTENER OR CLOSING DEVICE FOR PACKAGING

FIELD OF THE INVENTION

The invention relates generally to fasteners or closing devices for packaging. More particularly, the invention relates to fasteners or closing devices with self-fitting, self-adjusting, automatically adjusting and/or automatically fitting ability.

BACKGROUND OF THE INVENTION

Conventional methods to wrap or fasten a package require a user to use both hands. For example, to secure a package wrap with a tape, a user needs to hold the loose ends of the package wrap with one hand while taping them with another hand. Similar difficulty exists when using a Zipties® or Velcro® strap to secure a package. It requires a user to hold one end of the strap and the package in position with one hand while grasping the other end of the strap with the other hand in order to fasten the strap.

Within the field of material science, there has been an increasing study and development of shape memory polymers and shape memory alloys as a packaging material. Shape memory materials, such as shape memory polymers (SMP) and shape memory alloys (SMA) have the ability to return from a deformed state (temporary shape) to an original (e.g., baseline, memorized, permanent) shape induced by an external stimulus. For example, an SMP can exhibit change from a rigid state to an elastic state, then back to the rigid state using an external stimulus. The SMP in the elastic state can recover its "permanent" shape if left unrestrained. In similar respects, an SMA is an alloy that remembers its original shape and after undergoing deformation, is able to transform back to its pre-deformed, original shape when triggered to do so. As such, shape memory materials can be useful in various applications such as shrink wrapping, shrink tubing, and packaging.

Shrink wrap technology has been widely applied over or around a wide variety of items, such as roof tops, instruments, hazardous materials, cartoons, boxes, books, CDs, and DVDs. Shrink wrap technology relies on the use of a shape memory material (e.g., a polyolefin, polyethylene, polypropylene, PVC plastic film) which, when heated, shrinks and conforms to an object that it is covering. The shape memory material suitable for shrink wrap is available in a variety of thicknesses, clarities, strengths, and shrink ratios.

Shape memory materials have also been used to prepare expandable fasteners. U.S. Pat. No. 8,918,978 is directed to a method of joining a first component to a second component by aligning a first hole in the component with a second hole in the second component and inserting a fastener into the first hole and the second hole. The fastener comprises a shape memory alloy which is in a first shape having a diameter slightly larger than a diameter of the first hole and the second hole when the shape memory alloy is in an austenite state and reduced to a second shape having a diameter less than the diameter of the first hole and the second hole when the shape memory alloy is in a martensite state. After being inserted through the first and second holes, the fastener is heated to enable a phase transition to its austenite state, in which state the fastener has a diameter slightly larger than a diameter of the first hole and the second hole, and thus securely connects the two components.

A drawback in the prior art applications is that the shape memory materials give one or two different end shape results/permutations, with no gradual or intermediate shapes based on feedback. But sometimes, after initial setting of the shape memory material, an object enclosed by the shape memory material may slightly expand and/or contract as a result of shipment, transportation, or environmental factors (e.g. temperature, humidity). As such, the fasteners and packaging may cease to be fitted accurately on the underlying object and/or correspond in shape to the underlying object.

Therefore, it would be beneficial to provide a fastener or a closing device that provides self-assembling and/or self-closure about an object without manually maneuvering of the device relative to the object so that it is suitable for one handed or even hands free operation. Desirably, the fastener or the device may also conform to the shape of the object upon contact with an object to provide a tight and directed fitting. It would also be desirable for the fastener or the device to be able to automatically adjust the tightness and fitting of the package after the initial contact and also during a course of shipment or environmental changes.

SUMMARY OF THE INVENTION

It is an objective of the present invention to provide a fastener or an enclosure device for packaging that provides self-assembling and/or automatic closure about an object without manually maneuvering of the fastener or device relative to the object so that it is suitable for one handed or even hands free operation.

It is another objective of the present invention to provide a fastener or an enclosure device for packaging which may conform to the shape of the object upon contact with an object, and which may further automatically adjust the tension to provide a desired fitting (a hands free operation).

It is a further objective of the present invention to provide a fastener or an enclosure device that is able to automatically adjust the tightness and fitting of the package at the initial closure and also during a course of shipment, transportation, and storage.

It is another object of the present invention to provide a fastener, strap, or enclosure device that facilitates ease of opening and unwrapping of the package.

The present invention achieves these objectives by providing a self-closing and automatically fitting device for packaging. The device comprises a wrapping material having a shape memory material and a non-shape memory material, a trigger source configured to provide a stimulus to the shape memory material, and a few pairs of clasp members attached to the wrapping material. Upon receiving a trigger from the trigger source, the shape memory material in the wrapping material self-assembles into a temporary shape around the one or more objects of any shape, size, or dimension. This initial self-assembly brings the pairs of the clasp members together and facilitates the clasp of the clasp members to form a loop.

In a preferred embodiment, the stimulus is application of electric current. In another preferred embodiment the stimulus may be a blow heater type device as commonly used in shrink wrapping application. In another preferred embodiment, the clasp members include two magnetic pieces, with one magnetic piece on each clasp member.

The device may also include sensors disposed in the wrapping material, straps, and/or the clasp members, a motor disposed in one of the clasp members, the motor being configured to adjust a position of the clasp members with respect to the wrapping material, and a control unit communicatively connected to the trigger source, a motor, and sensors for adjustment throughout the packaging status. Specifically, the control unit regulates an amount of pressure exerted by the wrapping material and/or strap-clasp assembly on the object covered by the wrapping material, based on sensed information from the sensors, to control the activation and deactivation of the motor. This is also called motor actuated fine tuning/tensioning.

In some embodiments, the wrapping material may include at least one foam layer to provide protection to the underlying boxes. The wrapping material may be a laminate or "stack up" wrapping material with layers of foam/fabrics/actuators/circuitry/spacer/stiffeners. The plurality of clasp members may be permanently attached to the wrapping material by being sewn or otherwise permanently bonded to the wrapping material. Alternatively, the clasp members may be removably attached to the wrapping material by attaching to anchors, such as buckles, Velcro strap, or other adhesives, that are on the wrapping material. Preferably, both the clasp members and the wrapping material use Velcro straps for attachment.

In some embodiments, more than one motor and more than one controller may be used for individual control the fitting of the wrapping material and the clasp bands/straps. The motor suitable for use in the present invention may be a worm-gear motor, a lead screw actuator, or a rack and pinion motor, or any other motor assembly.

In some embodiments, the sensors may be disposed on the inner layer of the wrapping material for measurement. The sensors may be touch sensors, pressure sensors, force sensors, capacitive sensors, conductivity sensors, light or optical sensors, heat sensors, strain gauges, stress gauges, bend sensors, magnetic sensors, location sensors, accelerometer sensors, mechanical sensors (e.g., external buttons or levels, removable tabs/rods/latches, external sliders, bending-release latches, etc.), or a combination thereof or any additional type of sensor. A user may provide instructions related to the operation of the device directly or via the control unit.

For use, a box or boxes are placed on a sheet of the wrapping material. A trigger source is activated to provide a stimulus to the shape memory material, causing it to transform to a different form. The phase transformation of the shape memory material further causes the wrapping material to self assemble about the box or boxes, and also causes the clasp members move toward each other. As the two clasp members move closer to each other, they clasp to close the device, enclosing the box or boxes. The enclosing process does not require the use of a hand to manually hold the wrapping material, the clasp members, or the boxes. During the course of storage and/or transportation, the control unit regulates the degree of packaging (e.g., tightness) by the motor actuated fine tuning/tensioning.

In another aspect, the present invention provides a device for covering one or more objects for transport and/or storage which utilizes a plurality of clasp bands/straps having a shape memory material and clasp members to trigger a wrapping material to enclose the one or more objects. The device comprises a wrapping material in the form a sheet, a plurality of clasp bands attached to the wrapping material, and each of the plurality of clasp bands having two ends which are attached to two clasp members respectively. A first shape memory material is disposed in the plurality of clasp bands/straps. Upon receiving a stimulus from a first trigger source, the first shape memory material deforms which causes the clasp bands to curve, and which in turn pulls the wrapping material up to assemble around an underlying object. The curving of the clasp bands/straps also brings each pair of the clasp members closer to one other and facilitates the clasp of the clasp members.

In some of the embodiments, the wrapping material itself comprises a second shape memory material and a second trigger source. Thus, the wrapping material may self assemble when the second shape memory material therein receives a stimulus from the second trigger source. The self-assembly of the wrapping material may also facilitate the clasp of the clasp members.

Preferably, the first shape memory material comprises nitinol. Also preferably, the pair of clasp members comprise a pair of magnetic pieces with one magnetic piece on each clasp member.

The device having the clasp bands/straps may further comprise a motor disposed in one of the clasp members; the motor being configured to adjust a position of the clasp members with respect to the wrapping material in order to tighten or loosen the packaging; sensors disposed on the interior surfaces of the clasp members, the wrapping material, and a combination thereof; and a control unit in communication with the motor, the sensors, and the trigger source. The control unit is configured to control activation of the motor based on measurements provided by the sensors.

In a further aspect, the present invention provides a one piece clasp fastener for packaging. The one piece clasp fastener has an elongated body comprising a shape memory material and a non-shape memory material. The two ends of the one piece clasp fastener comprise two clasp members of a clasp such that, upon stimulation, the elongate body will curve as a result of the deformation of the shape memory material. In turn, the two ends of the clasp fastener move closer to each other and the two clasp members clasp with each other to form a hoop. The hoop of the clasp fastener encircles and conforms to the shape of a package, thereby providing support to the package.

The one piece clasp fastener may further have a motor, sensors, and a control unit to allow a motor actuated fine tensioning as described earlier embodiments.

In another embodiment, the present invention provides a two piece clasp fastener and band/strap that can be used for packaging that is made of normal (no SMAs or SMPs in the packaging materials) as opposed to "smart" packaging materials like shrink wrap. Each half of the band/clasp assembly includes an SAM/SMP material in the band/strap, a trigger source, a power source, a motor, and magnet, and has adhesive backing so that it can be attached directly onto the standard packing or wrapping material and function as closure of open ends of the packaging or wrapping material. This embodiment has the advantage of providing easy opening of the package by simply disengaging the clasps and pulling, which then tears the packaging material open because the bands of the clasp/band assembly were adhered to the package material.

DETAILED DESCRIPTION OF THE INVENTION

Figure 1:
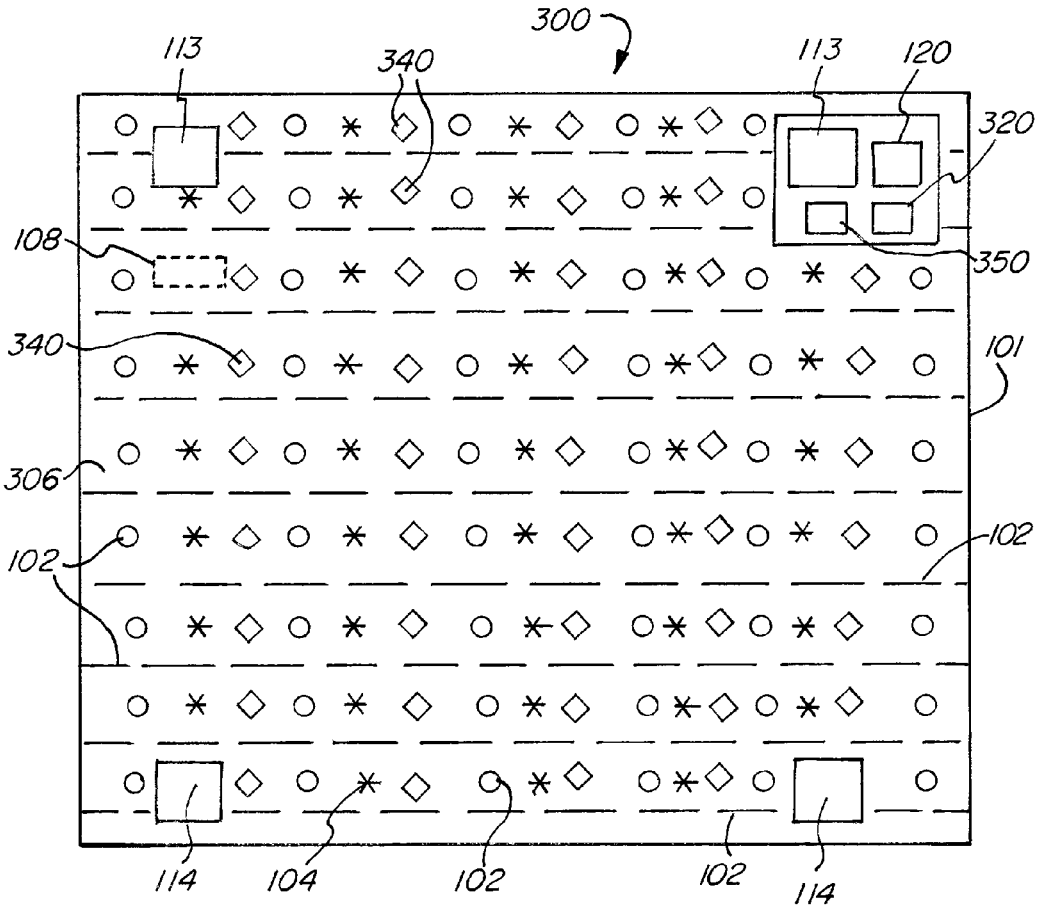
FIG. 1 shows an isometric view of a closing device having a plurality of clasp members for packaging in accordance with one embodiment of the invention.
Figure 2A:
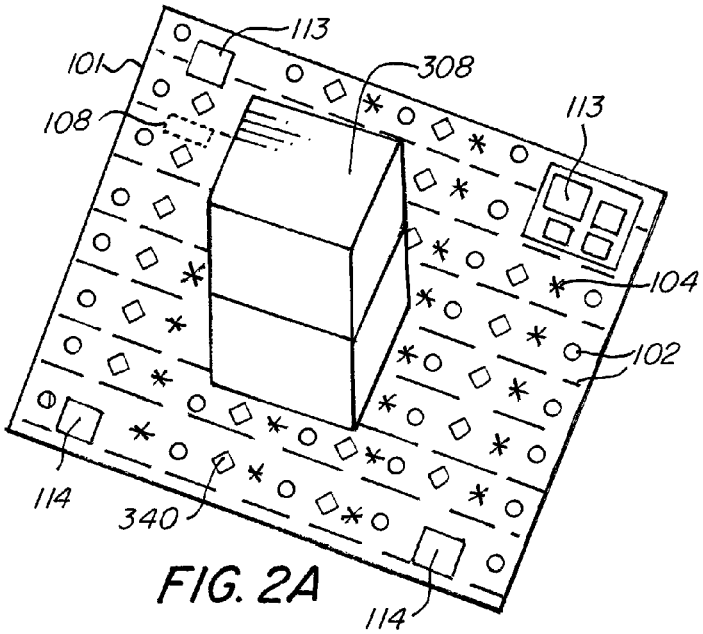
FIGS. 2A to 2C show an isometric view of a process of shrink wrapping an object using the closing device of FIG. 1.
Figure 2B:
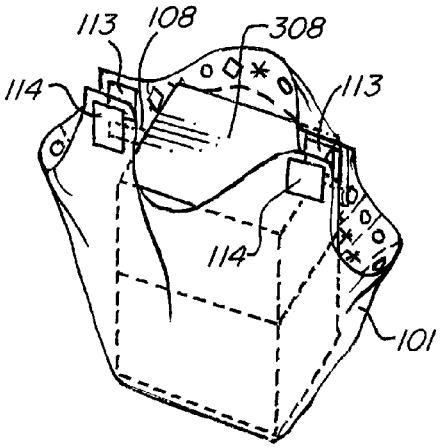
Figure 2C:
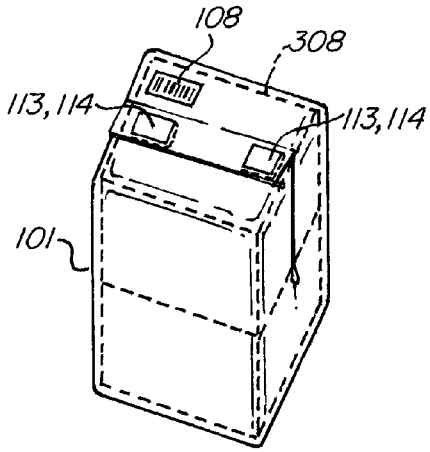

In one aspect, the present invention provides a packaging device which has an automatic closure and self-fitting function. FIG. 1 shows a lateral cross-sectional view of a device 300 which includes a wrapping material 101 having a shape memory material 102 and a non-shape memory material 104. The wrapping material 101 may comprise a mesh layer 306 on which the shape memory material and the non-shape memory material are deposited. In some embodiments, the non-shape memory material 104 is embedded with the shape memory material 102. The device 300 may include a trigger source 120 in communication with the shape memory material 102. The trigger source 120 is configured to provide a stimulus to the shape memory material 102. The device 300 may comprise a few pairs of clasp members 113, 114 near the sides of the wrapping material 101. The wrapping material 101 is configured to self-assemble into a temporary shape around the one or more objects 308, of any shape, size, or dimension, in response to a trigger received from the trigger source 120. Upon the initial self-assembly of the device, the pairs of the clasp members 113, 114 are brought together and clasp, which leads to the enclosure of the one or more objects in the device, as shown in FIGS. 2A to 2C. The enclosing process can be hands free.

The phrase "in communication with" with respect to the trigger source can mean that the trigger source has an effect, provides an effect, produces an effect on, and/or induces an effect on the shape memory material (e.g., transmit electricity to the shape memory material, pass a liquid to the shape memory material; transmit heat/cooling to the shape memory material; irradiate the shape memory material; adjust pH of shape memory material; effect a chemical reaction in the shape memory material, etc.). A preferred stimulus is application of electric current. Another preferred stimulus may be heat from a blower as used to change the configuration of a shrink wrapping material. Yet another stimulus may be the RFID signal from the reader or scanning device used to scan bar codes for inventory control. When the bar code is scanned, it also provides a stimulus or on/off switch type activation.

The shape memory material 102 may be formed from of one or more shape memory polymers (SMPs), one or more shape memory alloys (SMAs), or a mixture thereof. When a stimulus is applied or fed to the shape memory material, the modulus of elasticity of the material can change from a rigid or semi-rigid state to a flexible, malleable state suitable for reshaping and stretching the material. FIG. 1 shows that a shape memory material 102 in the form of wires and particles.

Suitable SMPs that may be used in the present invention include, but are not limited to, polyesters, polycarbonates, polyethers, polyamides, polyimides, polyacrylates, polyvinyls, polystyrenes, polyurethanes, polyethylene, polyether urethanes, polyetherimides, polymethacrylates, polyoxymethylene, poly-c-caprolactone, polydioxanone, polyisoprene, styrene copolymer, styrene-isoprene-butadiene block copolymer, cyanate ester, copolymers of stearyl acrylate and acrylic acid or methyl acrylate, norbonene or dimethaneoctahydronapthalene homopolymers or copolymers, malemide, silicones, natural rubbers, synthetic rubbers, and mixtures and compositions thereof. Further, the SMPs may be reinforced or unreinforced SMP material.

Suitable SMAs that may be used in the present invention include, but are not limited to, copper-aluminum-nickel alloys, nickel-titanium alloys, copper-zinc-aluminum alloys, iron-manganese-silicon alloys, gold-cadmium, brass, ferromagnetic, other iron-based alloys, and copper-based alloys. In a preferred embodiment, nitinol wires are used as the shape memory material. The nitinol wires, upon stimulation, will deform primarily in radius which creates both a tension and pressure type of adjustment. In one embodiment, the nitinol wires contract by about 4% to about 5% at 80° C.

Figure 3A:
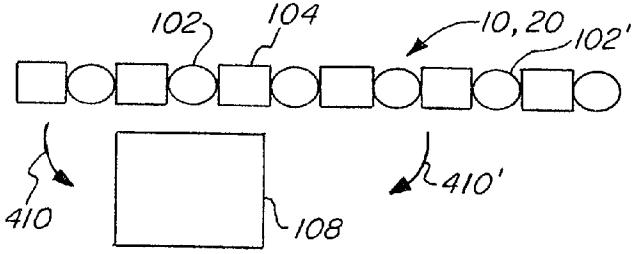
FIGS. 3A-3C are step views of a shape memory material having self-assembly and adaptive shape adjustment capability undergoing self-assembly around an underlying object and thereafter disassembly from the underlying object.
Figure 3B:
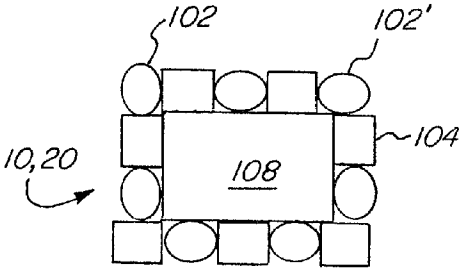
Figure 3C:
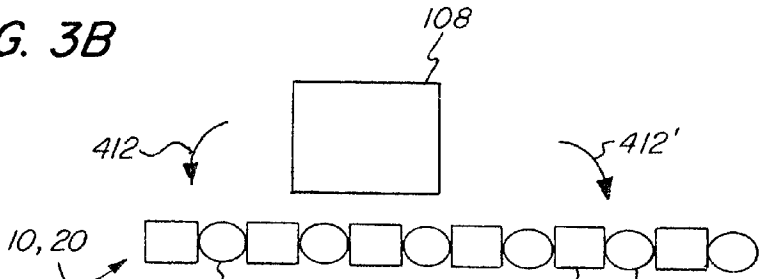

In some embodiments, the shape memory material comprises more than one shape memory material 102, 102' that provide counteracting actuations simultaneously, in directions 410, 410', from the memorized shape, as illustrated in FIG. 3A. The counteracting actuation function similar to muscle contraction in which the biceps and triceps provide for flexion and extension of the elbow joint, thereby contributing to functional movement of the arm. The two or more shape memory materials 102, 102' are adapted to counteract one another so that the wrapping material are able to self-assemble from a memorized shape (see FIG. 3A for example) to a first temporary shape (see FIG. 3B for example), cease self-assembly and maintain the first temporary shape. Additionally, the counteracting actuations of the two or more shape memory materials 102, 102' provide for adaptive adjustment (gradualism) of the wrapping material from the first temporary shape to other intermediate temporary shapes in order to compensate for changes in shape and/or size of the underlying object 108. Thereafter, if a "removal" trigger is transmitted by the trigger source to the shape memory material 102, 102', wrapping material may automatically disassemble in directions 412, 412', opposite to the directions 410, 410', respectively, thereby reverting back to its memorized shape (e.g., flat shape), as shown in FIG. 3C.

The non-shape memory material 104 may comprise, but is not limited to, one or more of the following materials: plastic, metal, rubber, fabric, mesh or ceramic. The non-shape memory material 104 may provide some rigidity and structural stability to the overall arrangement of the wrapping material. However, the non-shape memory material 104 does not prevent the wrapping material as a whole from transitioning between different shapes.

The mesh layer 306 of the wrapping material 101 may comprise a plastic material, foam material, and/or textile (e.g., fabric) material. Overall, the wrapping material 101 may be a laminate or "stack up" composite with layers of foam/fabrics/actuators/circuitry/spacer/stiffeners. The process of combining or intercalating the mesh layer and 306 shape memory materials 102 and non-shape memory materials 104 may involve threading, casting, coating, welding, and/or bonding.

The wrapping material 101 may also have a bar code 108 on an outer surface after wrapping. Such bar code 108 may be scanned and used for inventory control or as an integrated on/off switch, or activator and de-activator for the SMAs/SMP's in clasp motor and closing mechanism, or for the changes desired in the "smart" packaging material.

Any clasp members may be used on the device. Preferably, the clasp members 113, 114 comprise magnetic pieces 116, which may mutually attract and magnetically connect to each other to form an overlap to close the loop, without a prior physical contact. The magnetic pieces 116 may be of any suitable shapes. Since the magnetic force of attraction decreases with distance, this force is exerted most between the first and second magnet pieces when they are directly and substantially superposed on each other. Accordingly, not only should the two magnet pieces be matched magnets (namely, they are polarized in the same direction) so that they can be superposed on each other, the two magnet pieces also, preferably, have substantially the same size and same shape to maximize the exertion of magnetic force. The magnetic force between the magnet pieces causes the clasp members to adhere strongly to each other.

The magnet pieces may be permanent magnets made of neodymium-iron-boron. Those skilled in the art will understand that the mutually attracting magnetic pieces described previously could be electromagnetic fields or any other force types that can mutually attract and lock together.

Figure 4:
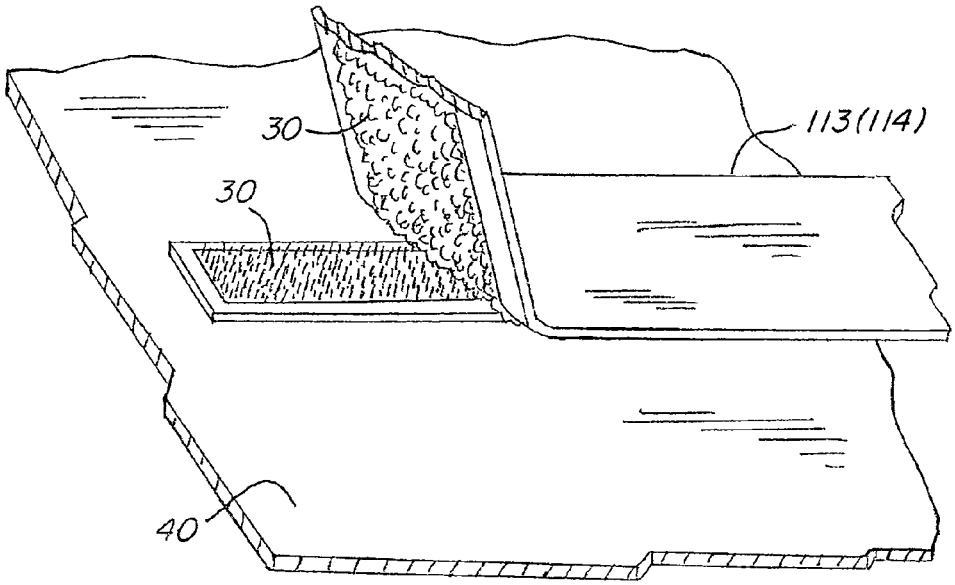
FIG. 4 shows an isometric view of the backing of a clasp member of the closing device of FIG. 1.

FIG. 4 shows details of the attachment of the clasp members 113, 114 to a surface of the device. One surface of the clasp members 113, 114 may comprise a fastening means for connecting them onto a wrapping material. The fastening means may be a permanent adhesive. In preferred embodiments, the fastening means is a hook-and-loop fastener 30, such as a Velcro strap. When the surface of another object 40 (e.g., a wrapping material, or closing device) provides a matching hook-and loop fastener, the clasp members may be easily and removably attached onto the object 40. Once attached to the object, the self-assembly triggered clasp of the clasp members 113, 114 may help the device to close an opening or loose ends of the wrapped package.

Referring back to FIG. 1, one of the clasp members 113, 114 may further comprise at least one motor 320 disposed thereon for fine tuning the tightness of the clasp members initially and during the courses of use. The clasp members 113, 114 may further comprise sensors 340 and a control unit 350 which is in communication with the sensors 340 and the at least one motor 320. The sensors 340 may also be positioned may be remotely from the clasp members (e.g., on the inner surface of the wrapping material). The sensors 340 are configured to acquire information related to the wrapped package and send sensed or acquired information (e.g., measurements) to the control unit 350.

Suitable sensors may be touch sensors, pressure sensors, force sensors, capacitive sensors, conductivity sensors, light or optical sensors, heat sensors, strain gauges, stress gauges, bend sensors, magnetic sensors, location sensors, accelerometer sensors, mechanical sensors (e.g., external buttons or levels, removable tabs/rods/latches, external sliders, bending-release latches, etc.), or a combination thereof or any additional type of sensor. In some embodiments, the sensors are configured such that number, configuration, type and pattern of the sensors in contact with an object determine timing for closing the band and tensioning of the band/strap. A user may select number, configuration, type, and pattern of the sensors to be in contact with an object and enter the selections in the user input unit so as to control timing for closing the band and tensioning of the band.

Based on the information received from the sensors 340, the control unit 350 sends triggering signals to the motors 320 to activate or deactivate a movement. The movement of the motor 320 changes the relative position of the clasp members 113, 114 with respect to the wrapping material, thereby fine tuning the fitting of the underlying subject.

Additionally, the motor may be used to superimpose two matched magnet pieces on each other for maximum magnetic force. In some embodiments, the control unit is configured so that, before clasping, the control unit instructs the motor to adjust the position of the second clasp member so that the two distal ends are aligned on top of each other with a magnetic piece on each end facing each other, thereby facilitating the two magnetic pieces to clasp by magnetic force.

The control unit 350 may be disposed in many places. In some embodiments, the control unit 350 may be disposed distantly away from the clasp or the object attached to the clasp. In other embodiments, the control unit 350 may be disposed in the clasp members, or the wrapping material.

Figure 5:
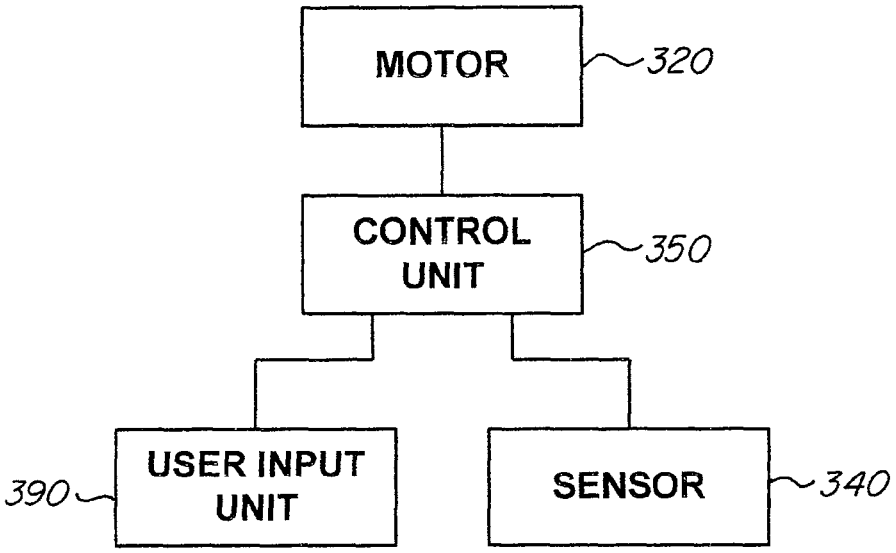
FIG. 5 shows a schematic view of an embodiment having a different mechanism to activate a motor.

In addition to the sensor triggered activation, activation of the motor 320 may be triggered by a user input. FIG. 5 is a block diagram showing the two types of activation mechanisms. In this diagram, the control unit 350 communicates with the sensors 340, which may trigger activation of the motor 320 through the control unit 350. At the same time, the control unit 350 also communicates with a user input unit 390. Upon receiving a triggering signal from the user input unit 390, the control unit 350 activates the motor 320 in accordance with the user input. The user input unit 390 may be a push button that can be pushed to activate the motor 320. The user input unit 390 may also be an interface on a computer, a handheld remote control, or on a smart phone which allows a user to manually provide instructions.

The activation of the motor 320 may be triggered by the sensors 340 and a user input unit 390 consecutively. The control unit 350 is configured so that, if the control unit 350 receives information from the user input 390 and the sensors 340 simultaneously, the information from the user input unit 390 controls.

Those skilled in the art understand that the control unit contains additional controls as necessary to work the invention correctly. Examples of such control would be an alarm/notification, automatic conversion to manual control, or automatic release of the tightness of the clasp/band assembly for safety purposes if the sensors determine it is tightened beyond safe parameters programmed into the control unit.

Figure 6:
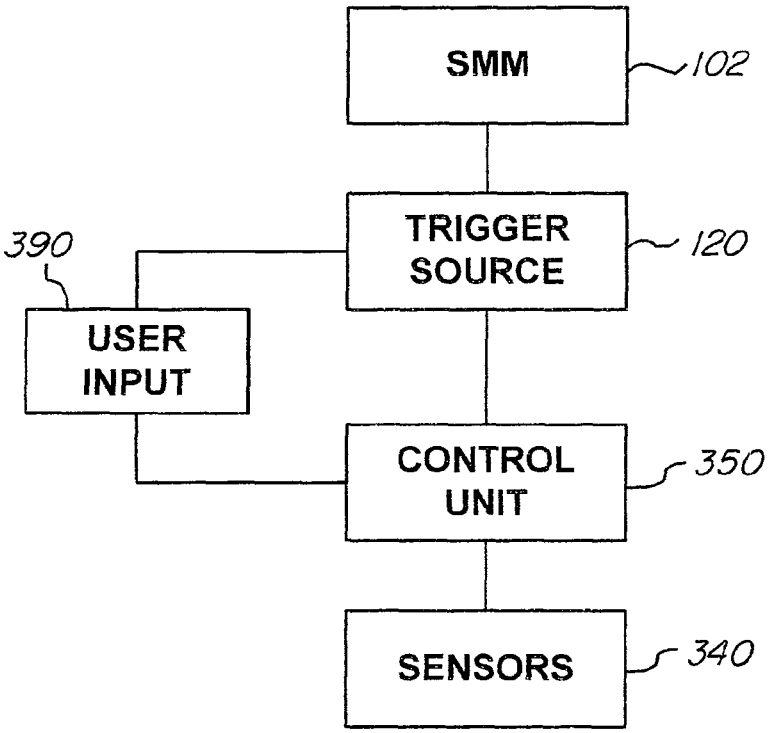
FIG. 6 shows a schematic view of an embodiment having a different mechanism to stimulate a shape memory material.

The control unit 350 may also be in communication with the trigger source 120 to control the activation and deactivation of the trigger source 120. For example, the control unit 350 may instruct the trigger source 120 to send stimulus to the shape memory material or cease stimulation based on sensed information from the sensors 340. The user input unit 390 may be configured to directly control the trigger source 120. FIG. 6 is a block diagram showing the activation mechanism.

The trigger source 120 may generate a stimulus to the shape memory material 102 based on instructions received from the user input unit 390. The user input unit 390 may be in the form of, for example, a switch, a knob, a push button, or a touch screen. After the push button is pushed, the trigger source 120 creates and applies a stimulus (e.g., electric circuit) to the shape memory material 102, causing the shape memory material 102 to deform, and the two clasp members to approach one another. In other embodiments, the user input unit 390 is an interface on a computer, a handheld remote control device, or a smart phone, in which case, the trigger source 120 may receive instructions directly from the touch screen of a computer, a handheld remote control device, or a smart phone. The user input unit 390 may also allow a user to set threshold levels of various sensors. It may further allow a user to select the types and locations of various sensors dispersed on the band/strap, clasp, and/or wrapping material.

In a preferred embodiment, a remote control unit wirelessly, for example, via a blue tooth device, communicates with the shape memory alloy wires in the wrapping material. The remote control unit initiates the first of the pair of clasp members to move toward the center of the arc of desired motion, and subsequently, initiates the second of the clasp members to move along the same arc of motion so that the two ends are aligned on top of each other with a magnetic piece on each end facing each other before clasping, while compensating automatically for any mal-position that may occur when the wrapping material is initially laid on the object.

Motors suitable for use in the present invention may be any type, including, but not limited to, an electric motor, an electrostatic motor, a pneumatic motor, a hydraulic motor, a fuel powered motor. In a preferred embodiment, the motor is an electric motor that transforms electrical energy into mechanical energy. Additionally, the motor should be small enough to be housed in a clasp member. It is also preferred that the motor can complete the tensioning or fine tuning quickly upon receiving instructional triggering signals. For example, in some embodiments, it takes the motor 320 as short as 1-2 seconds to increase or decrease a relative position by approximately +/−6 mm to achieve a fine tuning. Commonly known electric motors such as a lead screw actuator, a worm-gear type motor, or a rack and pinion motor, ratcheting motor, hydraulic, pneumatic or other types of motors may be used in the present invention. The motor and its mechanisms may be made of throw away or disposable plastic and 3D printed, so as to be economically feasible to be used once and discarded. The battery or power source can be simple and short lived, or rechargeable and long lived depending on the type of motor or intended use. The clasp/strap and hoop configuration can be made to be re-usable, such as in movers packing, unpacking, and repacking items.

By using sensors to acquire information and trigger the activation and/or deactivation of the motor in order to fine tune the tightness of a package as needed, the present invention advantageously provides a device that not only can close by self-assembly to provide a package but also can automatically adjust and substantially maintain a preferred tightness thereof during packaging.

The device 300 may further comprise at least one power source to supply power to the motor 320, and optionally to the control unit 350, the trigger source 120, and the sensors 340. In some embodiments, the motor 320 may be associated with an external battery 360. In preferred embodiments, the motor 320 may include an internal battery (not shown). An external battery may also be placed in the wrapping material 101. The battery may be any type, shape, or form of battery. It may be a disposable battery or a rechargeable battery. The control unit may contain a program to notify the user of need to replace a disposable battery or to charge the rechargeable battery.

The control unit 350 may also contain a program to control the device inventory by being able to receive and process a scanned bar code information regarding the device, for example, from a scanner (not shown). The control unit 350 may further trigger the activation of the shape memory material upon receiving signals (e.g., RFID signals) from the scanner.

In a further aspect, the present invention provides a device 300 for use in wrapping and packaging which comprises a plurality of clasp bands/straps which trigger an initial enclosure of the package.

Figure 7A:
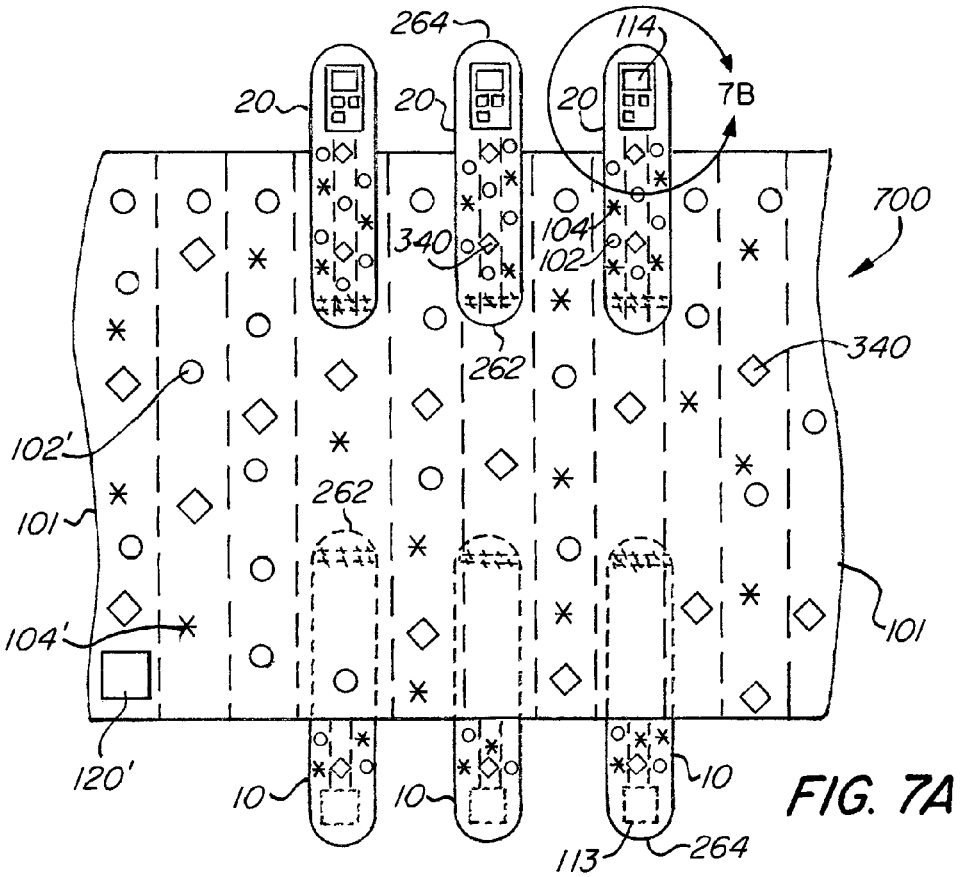
FIGS. 7A and 7B shows an isometric view and an enlarged sectional view of a closing device having a plurality of clasp bands/straps for packaging wherein the wrapping material contains shape memory materials in accordance with another embodiment of the invention.
Figure 7B:
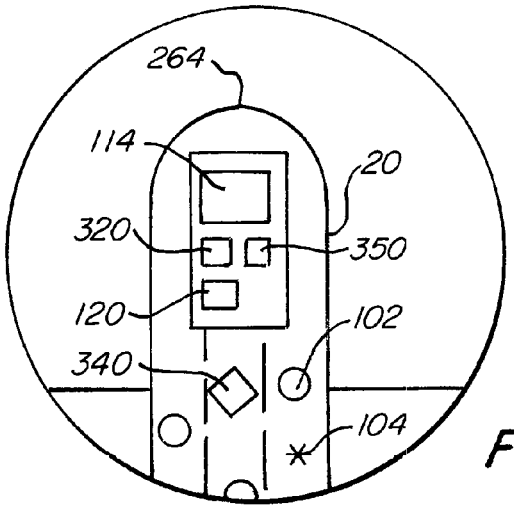

As shown in FIGS. 7A and 7B, the device 700 comprises a wrapping material 101 in the form a sheet, a plurality of clasp bands/straps 10, 20 attached to the wrapping material, and each of the plurality of clasp bands/straps having two ends 262, 264 which are attached to two clasp members 113, 114, respectively. A first shape memory material 102 is disposed in the plurality of clasp bands/straps 10, 20. Upon receiving a stimulus from a first trigger source 120, the first shape memory material 102 deforms and causes the clasp bands/straps 10, 20 to curve, which in turn pulls the wrapping material 101 to assemble around an underlying object 308. The curving of the clasp bands/straps 10, 20 also brings each pair of the clasp members 113, 114 closer to one other and facilitates the clasp of the clasp members. Because it requires two (e.g., a pair of) the clasp bands/straps to clasp, the clasp bands/straps in these embodiment are also called "half" bands/straps.

In a preferred embodiment, the first shape memory material comprises nitinol. In another preferred embodiment, the pair of clasp bands/straps comprise a pair of magnetic clasp members, with one magnetic piece on each end of the clasp bands/straps.

The device 700 may further comprise a motor 320 disposed in one of the clasp members 113, 114; sensors 340 disposed on interior surfaces of the clasp members 113, 114, the wrapping material 101, and a combination thereof; and a control unit in communication with the motor, the sensors, and the trigger source. The motor 320 is configured to adjust a position of the clasp members 113, 114 with respect to the wrapping material 101 in order to tighten or loosen the closed package. The control unit 350 is configured to control activation of the motor 320 based on measurements provided by the sensors 340.

FIGS. 7A and 7B shows that the wrapping material 101 itself comprises a second shape memory material 102' and a second trigger source 120'. Thus, the wrapping material 101 may self assemble when the second shape memory material 102' therein receives a stimulus from the second trigger source 120'. The self-assembly of the wrapping material 101 may also facilitate the clasp of the clasp members 113, 114. More than one motor and more than one controller may be used for individual control the fitting of the wrapping material and the clasp bands/straps.

Figure 7C:
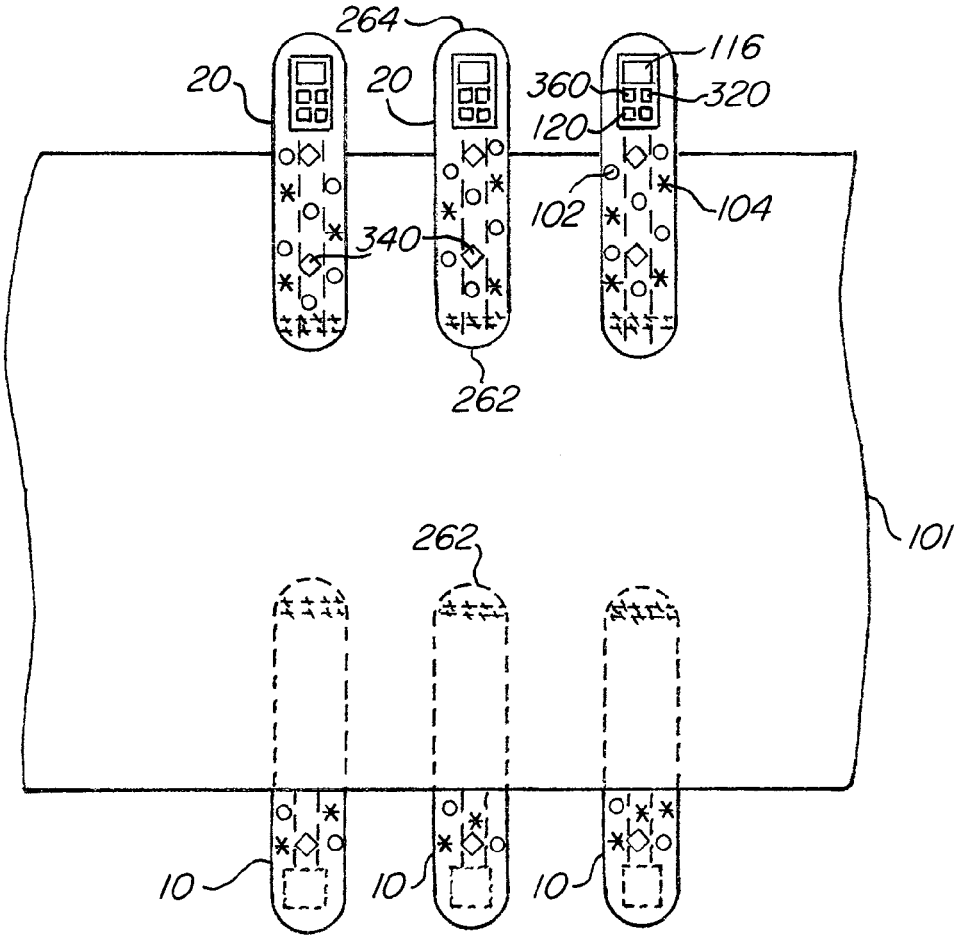
FIG. 7C shows a pull apart assembly of two separately anchored half band/clasp devices wherein the wrapping material has no shape memory material.

FIG. 7C shows a two piece clasp fastener and band/strap that can be used for packaging that is made of normal material 101 (no shape memory alloys or shape memory polymers in the packaging materials) as opposed to "smart" packaging materials like shrink wrap. Each half of the band/clasp 10, 20 assembly includes an shape memory alloy or shape memory polymer material 102 in the band/strap 10, 20, a trigger source 120, a power source 360, a motor 320, and magnet 116, and has adhesive backing so that it can be attached directly onto the standard packing or wrapping material and function as closure of open ends of the packaging or wrapping material. This embodiment has the advantage of providing easy opening of the package by simply disengaging the clasps and pulling, which then tears the packaging material open because the bands of the clasp/band assembly were adhered to the package material.

While FIGS. 7A and 7C each show only three pairs of clasps/bands attached to a wrapping material, a person skilled in the art would understand that more or less pairs of clasps/bands may be attached. Alternatively, more than one clasp/band may be attached to one another to form a longer clasp/band. In some embodiments, each pair of clasp bands/straps are individually constructed, each clasp/band comprises its separate shape memory material, separate trigger source, separate sensors, separate magnets, etc. Laser beam detection sensor mechanisms, RF sensor mechanisms, or any other sensor mechanism (e.g., non-laser activation and non RF sensor mechanisms) may act as on/off controllers for timing the synchrony of the SMA's and SMP's closures with the timing of the magnet locking or matching mechanisms or mechanics of closure timing, In some embodiments, the wrapping material is pre-equipped with hook-and-loop fasteners for closing the material after wrapping. The clasp-bands/straps may be attached to the hook and loop fasteners such that the clasp-bands/straps may function as hinges, rather than using the velcro adhesive backed strip for attachment to the wrapping material. Hinge-like clasp-bands/straps allow for a larger radius of closure when combined with the characteristics of the nitinol. In preferred embodiments, each hinge may be equipped with a small motor attached that is connected to a general feedback loop together with nitinol so that the hinge gets the big parts of the closure done where the nitinol radius of contraction is too small.

The number of different SMAs and SMPs or combinations thereof incorporated into the device or wrapping material depends on choosing the correct combination of SMAs and SMPs to achieve the desired functions and is not limited to two, but rather unlimited numbers of combinations.

The types, functions, and preferred embodiments of the clasp members, the shape memory materials, the wrapping material, the trigger source, the motor, the sensors, and the control unit suitable for use in the device having shape memory material embedded clasp bands/straps are substantially the same as those discussed earlier. Additionally, a battery 360 may be used to supply power to the motor, the control unit, etc. The operation of the device (e.g., the operation of the trigger source, the motor, and the control unit) can be controlled by a user. The control unit and the motor may enable the alignment of the magnetic pieces before they clasp. Detailed information of these components and functions will not be repeated.

Figure 8A:
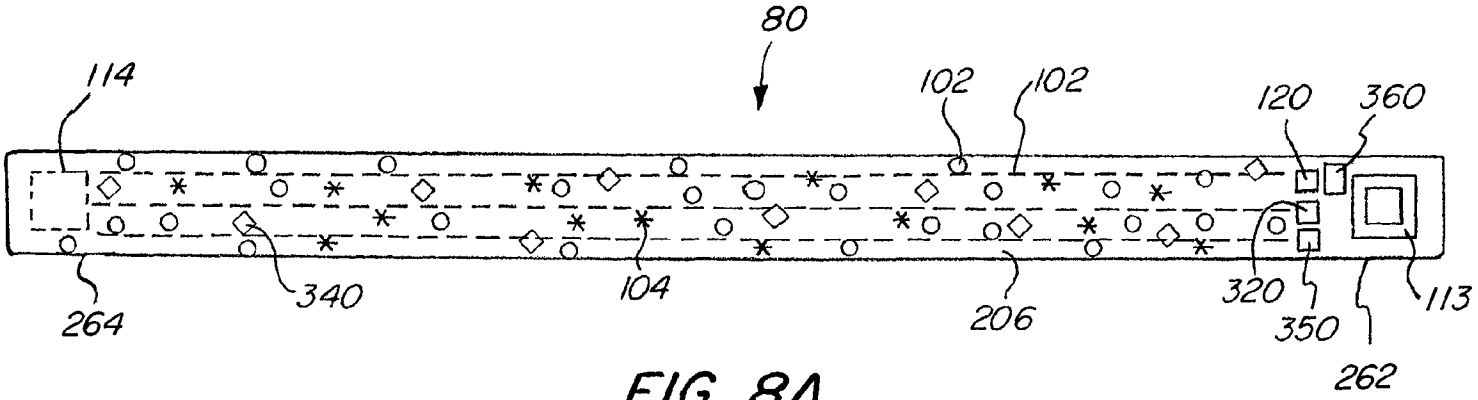
FIG. 8A shows a cross-sectional view and an isometric view of a clasp fastener in accordance with a further embodiment of the invention.

In a further aspect, the present invention provides a one-piece clasp fastener for packaging. As shown in FIG. 8A, the one piece clasp fastener 80 is an elongated band/strap comprising a shape memory material 102 and a non-shape memory material 104. The one piece clasp fastener 80 may further comprise a liner layer 206 on which the shape memory material 102 and the non-shape memory material 104 are deposited. The two ends 262, 264 of the one piece clasp fastener 80 comprises two clasp members 113, 114 of a clasp. The one piece clasp fastener 80 may comprise a trigger source 120 in communication with the shape memory material 102 and configured to provide a stimulus to the shape memory material 102.

Figure 8B:
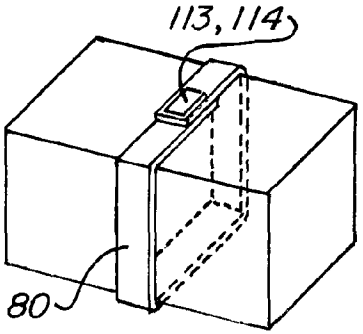
FIG. 8B shows an isometric view of the clasp fastener of FIG. 8A being used to secure a package.

Upon receiving a stimulus, the shape memory material 102 transforms from the current temporary form to its original form (a more stable form), causing the one piece clasp fastener 80 to deform and bring the two ends 262, 264 to move toward each other, and would wrap around an object if present. As the two end portions 262, 264 move closer to each other, the two clasp members 113, 114 clasp to form a loop. (FIG. 8B).

The one piece clasp fastener 80 has two opposite surfaces of substantially the same area and shape. In some embodiments, the back of the one piece clasp fastener 80 may comprise a fastening means for connecting the clasp fastener 80 to a surface of a package or a wrapping material (not shown). The fastening means may be a permanent adhesive or a non-permanent one, such as a hook-and-loop fastener. Once attached to a wrapping material, the one piece clasp fastener 80 may help the wrapping material to self-assemble, if feasible, and to enclose an object.

The one piece clasp fastener 80 may close and/or support a package even without previously attaching to the object. For example, the one-piece clasp fastener may be placed around a package with the two loose ends of the one-piece clasp fastener hanging around the object but not in contact with each other. Upon stimulation, the shape memory material undergoes a phase transition. The phase transition brings the two loose ends close to each other, thereby facilitating the clasp of the two ends of the one-piece band/strap clasp. Upon the clasp, the one-piece clasp fastener forms a hoop which encircles and conforms to the shape of the package, thereby providing support to the object and/or closing an opening of the package, as shown in FIG. 8B.

Unlocking the magnet clasps with their attached band/strap assembly of any configuration and removing them to open the package is easier than tearing the wrapping material off the wrapped object.

The one piece clasp fastener 80 may further have a motor 320, sensors 340, and a control unit 350 to allow a motor actuated fine tensioning, as discussed in earlier embodiments. The components shown in FIGS. 8A and 8B which have been discussed before will not be discussed again.

While the present teachings have been described above in terms of specific embodiments, it is to be understood that they are not limited to those disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. A closing device for packaging, comprising:

a wrapping material having a shape memory material and a non-shape memory material, the wrapping material further comprising a mesh layer on which the shape memory material and the non-shape memory material are deposited;

at least one pair of clasp members attached to the wrapping material, a trigger source in communication with the shape memory material, the trigger source being configured to provide a stimulus to the shape memory material, wherein the wrapping material is configured to self-assemble between a memorized shape and a temporary shape around one or more objects in response to a stimulus from the trigger source, thereby bringing the at least one pair of clasp members closer to one another, and thereby facilitating the clasp of the at least one pair of clasp members, wherein the self-assembly of the wrapping material affixes around the one or more objects in a fixed manner, and wherein the clasp of the at least one pair of clasp members closes the wrapping material about the one or more objects.

2. The device of claim 1, wherein the at least one pair of clasp members are removably attached to the wrapping material.

3. The device of claim 2, wherein the at least one pair of clasp members and the wrapping material are attached to each other via a hook and loop fastener.

4. The device of claim 1, wherein the shape memory material comprises at least one of a shape memory polymer or shape memory alloy.

5. The device of claim 1, wherein the shape memory material comprises two shape memory materials, wherein the two shape memory materials provide counteracting actuation such that a first shape memory material is configured to shape transition in a first direction in response to a first stimulus and a second shape memory material is configured to shape transition in a second direction in response to a second stimulus simultaneously, the second direction being opposite the first direction.

6. The device of claim 1, wherein the non-shape memory material comprises at least one of plastic, metal, rubber, fabric, mesh, or ceramic.

7. The device of claim 1, wherein the at least one pair of clasp members comprise a pair of magnetic pieces, one magnetic piece on each clasp member, wherein the two magnetic pieces are mutually attracted to each other by magnetic force over a space, such that the clasp members clasp to form an overlap without prior physical contact.

8. The device of claim 1, wherein the trigger source is application of electric current.

9. The device of claim 1, wherein the stimulus is an RFID signal from a scanner, wherein the device further comprises a bar code disposed on an outer surface of the wrapping material, and wherein upon scanning the bar code with the scanner, the scanner retrieves inventory information from the bar code and transmits an RFID signal to the shape memory material.

10. The device of claim 1, further comprising:

a motor disposed in one of the at least one pair of clasp members, the motor being configured to adjust a position of the at least one pair of clasp members with respect to the wrapping material in order to tighten or loosen the device, sensors disposed on interior surfaces of the at least one pair of clasp members, the wrapping material, and a combination thereof, and a control unit in communication with the motor, the sensors, and the trigger source, wherein the control unit is configured to instruct the trigger source to send a stimulus to the shape memory material; and wherein the control unit is configured to control activation and deactivation of the motor based on measurements provided by the sensors.

11. The device of claim 10, wherein the control unit is configured to start the activation of the motor if the measurements provided by the sensors are higher or lower than a predetermined threshold value, and wherein the control unit is configured to cease the activation of the motor if the measurements provided by the sensors reach the predetermined threshold value.

12. The device of claim 10, further comprising a user input unit in communication with the trigger source and the control unit, wherein the control unit is configured to control activation of the motor in response to instructions provided by the user input unit, and wherein the trigger source is configured to send a stimulus to the shape memory material in response to instructions provided by a user input unit.

13. The device of claim 10, wherein the at least one pair of clasp members comprise a pair of magnetic pieces with one magnetic piece on each clasp member, wherein the control unit is further configured that, before clasping, the control unit instructs the motor to adjust the position of the clasp members so that the two clasp members are aligned on top of each other with a magnetic piece on each end facing each other, thereby facilitating the two magnetic pieces to clasp by magnetic force.

14. The device of claim 10, wherein the sensors are touch sensors, pressure sensors, force sensors, capacitive sensors, conductivity sensors, light or optical sensors, heat sensors, strain gauges, stress gauges, bend sensors, magnetic sensors, location sensors, accelerometer sensors, mechanical sensors, or a combination thereof.

15. A device for covering one or more objects for transport and/or storage, comprising:

a wrapping material in the form a sheet, a plurality of clasp bands attached to the wrapping material, each of the plurality of clasp bands having a proximal end and a distal end, a first shape memory material disposed in the plurality of clasp bands, a first trigger source in communication with the first shape memory material, a plurality of clasps, each of the plurality of clasps having two clasp members, wherein each of the plurality of clasp bands attaches to one or two of the clasp members on one or both of its proximal and distal ends, wherein the first trigger source is configured to provide a stimulus to the first shape memory material, wherein the first shape memory material is configured to transition between a temporary shape and a memorized shape automatically upon receipt of a stimulus, and wherein the transition of the first shape memory material causes the two ends of the plurality of clasp bands to move towards to each other, thereby causing the wrapping material to assemble around an underlying object, and thereby facilitating the clasp of the two clasp members so as to wrap the object.

16. The device of claim 15, wherein the at least one pair of clasp members comprise a pair of magnetic pieces with one magnetic piece on each clasp member.

17. The device of claim 15, wherein the first shape memory material comprises nitinol.

18. The device of claim 15, wherein wherein the wrapping material further comprises a second shape memory material and a second trigger source disposed on the wrapping material, the second trigger source in communication with the second shape memory material, wherein the second trigger source is configured to provide a stimulus to the second shape memory material, wherein the second shape memory material is configured to transition between a temporary shape and a memorized shape automatically upon receipt of a stimulus, and wherein the transition of the second shape memory material also causes the two ends of the plurality of clasp bands to move towards to each other, thereby facilitating the clasp of the two clasp members.

19. The device of claim 15, further comprising:

a motor disposed in one of the clasp members, the motor being configured to adjust a position of the clasp members with respect to the wrapping material, sensors disposed on interior surfaces of the clasp members, the wrapping material, and a combination thereof, and a control unit in communication with the motor, the sensors, and the trigger source, and wherein the control unit is configured to control activation of the motor based on measurements provided by the sensors.

20. A clasp fastener for packaging comprising:

an elongated body having two end portions, a clasp having first and second clasp members attached to the two end portions of the elongated body respectively so as to connect or disconnect the two end portions, a motor disposed in one of the clasp members, a shape memory material disposed in the elongated body, the shape memory material comprising a nitinol, a trigger source in communication with the shape memory material, sensors disposed on the elongated body of the clasp fastener, a control unit in communication with the trigger source, the motor, and sensors, wherein the trigger source is configured to provide a stimulus to the shape memory material, wherein the shape memory material is configured to transition between a memorized shape and a temporary shape upon receipt of a stimulus, wherein the motor is configured to adjust a position of the clasp with respect to the elongated body, wherein the control unit is configured to instruct the trigger source to provide a stimulus to the shape memory material in response to sensed information provided by the sensors, causing the band to curve with its end portions moving toward the center of an arc of a closed position of the fastener, thereby facilitating the clasp of the clasp members, wherein upon the clasp, the clasp fastener forms a hoop which encircles and conforms to the shape of a package, and wherein the control unit is configured to control activation and deactivation of the motor based on measurements provided by the sensors to adjust the tightness of the clasp fastener on the package.

* * * * *